United States Patent [19]

Greenway

[11] Patent Number: 4,524,530

[45] Date of Patent: Jun. 25, 1985

[54] SPUR EQUIPPED BOOT

[76] Inventor: Peter R. Greenway, 5105 Mount Nemo Rd., R.R. #2, Milton, Ontario, Canada, L9T 2X6

[21] Appl. No.: 485,387

[22] Filed: Apr. 13, 1983

[30] Foreign Application Priority Data

Jan. 6, 1983 [CA] Canada ..... 418964

[51] Int. Cl.[3] ..... A43B 3/00

[52] U.S. Cl. ..... 36/113; 36/7.1 R; 36/62; 182/221

[58] Field of Search ..... 36/7.7, 7.1 R, 113, 36/124, 136, 62, 65, 66, 1, 1.5, 83, 87, DIG. 2; 182/134, 221

[56] References Cited

U.S. PATENT DOCUMENTS

| | | | |
|---|---|---|---|
| 303,955 | 8/1884 | Spencer | 36/62 |
| 2,284,190 | 5/1942 | Evans | 182/221 X |
| 3,640,358 | 2/1972 | Smith | 182/221 |
| 4,153,139 | 5/1979 | Houch | 182/134 X |
| 4,198,771 | 4/1980 | Foster | 36/136 |
| 4,282,951 | 8/1981 | Zelins | 182/134 X |

FOREIGN PATENT DOCUMENTS

| | | | |
|---|---|---|---|
| 374479 | 8/1939 | Italy | 36/7.1 R |
| 1232132 | 5/1971 | United Kingdom | 182/221 |
| 2103069 | 2/1983 | United Kingdom | 36/7.1 R |

*Primary Examiner*—Werner H. Schroeder
*Assistant Examiner*—Tracy G. Graveline
*Attorney, Agent, or Firm*—Joseph G. Seeber

[57] ABSTRACT

A lineman's climbing aid comprising an outer boot adapted to be worn over a standard workboot and a replaceable steel gaff rigidly fastened exteriorly against an inside wall portion of the outer boot, wherein the outer boot comprises a one-piece molding of electrically insulating, water-impermeable, plastics material defining a rigid shell and a steel reinforcing plate embedded within said inside wall portion of the shell, the gaff being fastened to the reinforcing plate by fastening means extending through said inside wall portion whereby said inside wall portion is rigidly clamped between the reinforcing plate and the gaff.

5 Claims, 3 Drawing Figures

SPUR EQUIPPED BOOT

FIELD OF THE INVENTION

This invention relates to linemen's climbing aids, and is concerned particularly with outer footwear which, besides providing an electrically insulating sheath for the user's foot to afford dielectric protection, incorporates a gaff or climbing spur which is wholly insulated from the user's body.

BACKGROUND OF THE INVENTION

Linemen servicing high voltage power lines and the like are required to climb poles, for which purpose it has long been known to provide climber's (sometimes referred to as "spurs" or "hooks") which are strapped to the legs of a user. A conventional climber of this type is described in U.S. Pat. No. 2,200,450, issued May 14, 1940, to Joseph A. Klein Jr. The conventional climber comprises a leg iron having an upper portion which is strapped to the leg of the user and a lower portion which extends beneath the user's foot and terminates in a fastening for the straps by which the climber is fastened to the leg; the gaff is rivited or otherwise secured to the leg iron.

The conventional climber is convenient to use since it can be worn over a standard workboot and can very easily be fitted when required or removed when not required. However, the configuration which is made necessary in order that it may be strapped firmly and positively to the user's leg and foot, has two inherent disadvantages. First, and more serious, the upper or shank portion must extend along a portion of the user's leg and so constitute an electrical hazard. If the gaff or any part of the climber touches an earth connection while the lineman is working with high voltage equipment the lineman will sustain an electrical shock. The second disadvantage is that the lower portion of the leg iron which extends beneath the foot causes considerable discomfort in use, and over a long working period will restrict blood circulation in the user's foot.

SUMMARY OF THE INVENTION

The present invention provides a lineman's climbing aid which affords all the convenience of the conventional climbing aid referred to above, but which also overcomes the serious disadvantages inherent in the latter. This is achieved by providing, instead of a leg iron to be strapped to the user's leg, a rigid outer boot which is worn over the standard workboot and which incorporates the gaff in a unitary assembly.

Thus, according to the invention there is provided a lineman's climbing aid comprising an outer boot adapted to be worn over a standard workboot and a replaceable steel gaff rigidly fastened exteriorly against an inside wall portion of the outer boot. Wherein the outer boot comprises a one-piece molding of electrically insulating, water-impermeable, plastics material defining a rigid shell and a steel reinforcing plate embedded within said inside wall portion of the shell, the gaff being fastened to the reinforcing plate by fastening means extending through said inside wall portion whereby said inside wall portion is rigidly clamped between the reinforcing plate and the gaff.

It should be mentioned that the present invention does not reside merely in the concept of providing a boot with a replaceable gaff. U.S. Pat. No. 4,198,771 discloses a hunter's boot having a climbing spike which can be attached when needed to assist in tree climbing. The upper of the boot is flexible and the climbing spike is attached by means of a rigid bar which extends through a slot in the sole assembly. The present invention, on the other hand, relates to an electrically insulating overboot for use by linemen, the gaff being attached in a manner which minimizes electrical hazard while not encumbering the user.

BRIEF DESCRIPTION OF THE DRAWINGS

One preferred embodiment of the invention will now be described, by way of example, with reference to the accompanying drawings, in which.

DESCRIPTION OF THE PREFERRED EMBODIMENT

Figure 1:
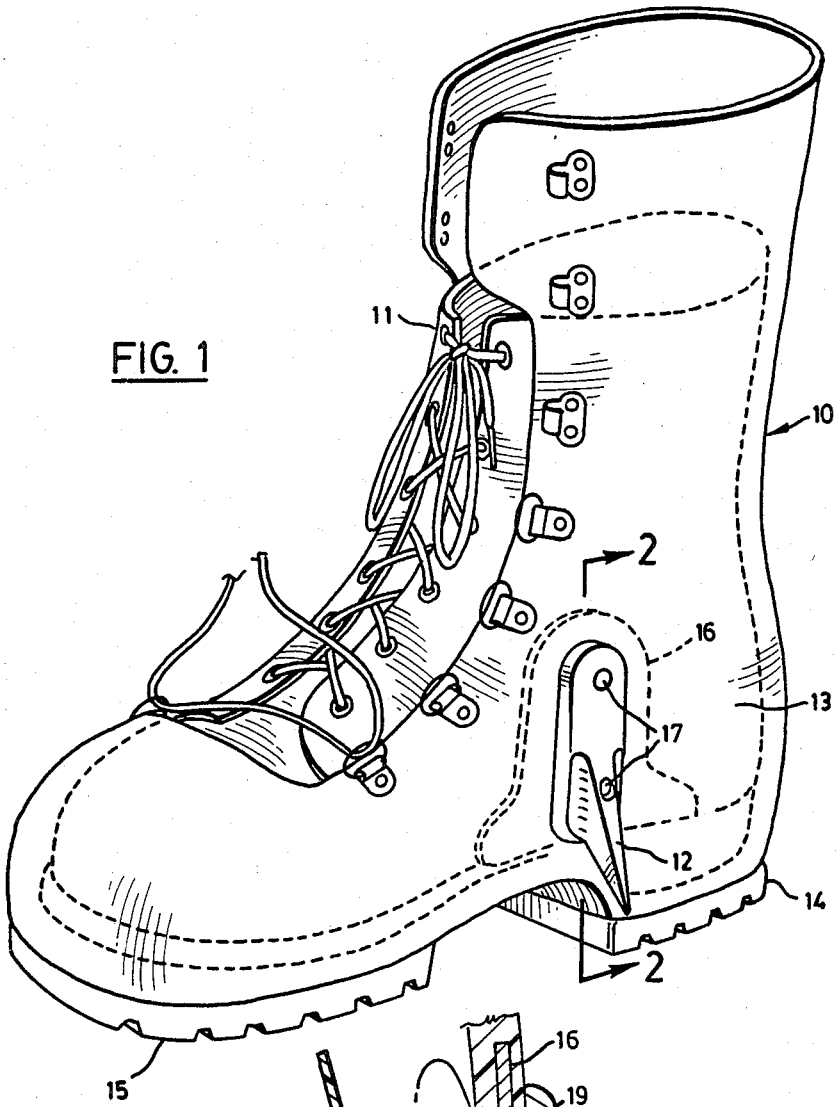
FIG. 1 is a perspective view of the climbing aid as worn over a standard workboot.

Referring to the drawings, the climbing aid basically comprises an outer boot 10 which is adapted to be worn over an inner boot, such as a standard workboot 11 of the type normally worn by linemen, and a conventional gaff 12 which is rigidly fastened against the exterior of the inside wall portion 13 of the outer boot. The illustrated boot is for the right foot, and the left side portion of the upper is referred to herein as the inside wall portion as distinguished from the outside wall portion which lies along the outside of the foot.

The outer boot 10 comprises a one-piece molding of electrically insulating, water-impermeable, plastics material formed as a rigid shell to receive the inner boot 11. The upper portion of the shell has a large frontal opening shaped to facilitate the insertion of the user's foot and inner boot. Conventional lace-up fastenings are provided to hold the outer boot securely on the foot.

The shell is a rigid one-piece molding of thermoplastics material, preferably nylon or "Zytel", which is a fibrous nylon manufactured by Dupont. The material must be of a type and thickness to afford adequate electrical insulation to protect the user, and must be water-impermeable since ingress of moisture would impair the insulation. Also the material must have sufficient rigidity to enable the user to have secure purchase when his weight is applied to the gaff. The shell constitutes the upper and underside portions of the outer boot which are integral with one another. A heel 14 and a sole 15 are cemented to the underside of the shell, preferably by a heat activated urethane adhesive, these being of a synthetic rubber composition and manufactured by Quabug Rubber Company of North Brookfield, Mass. under the trade mark "Vibram".

Figure 2:
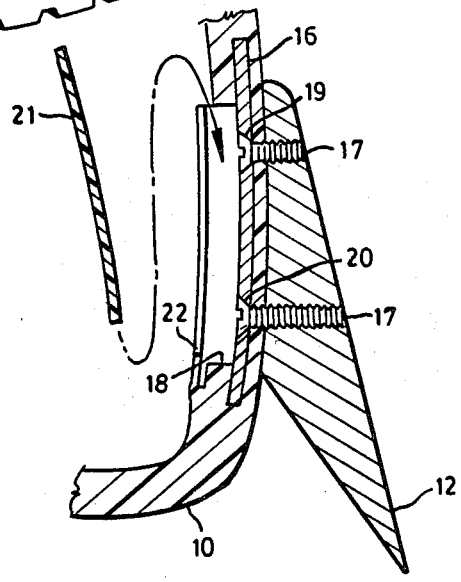
FIG. 2 is an enlarged sectional view taken on line 2—2 in FIG. 1.
Figure 3:
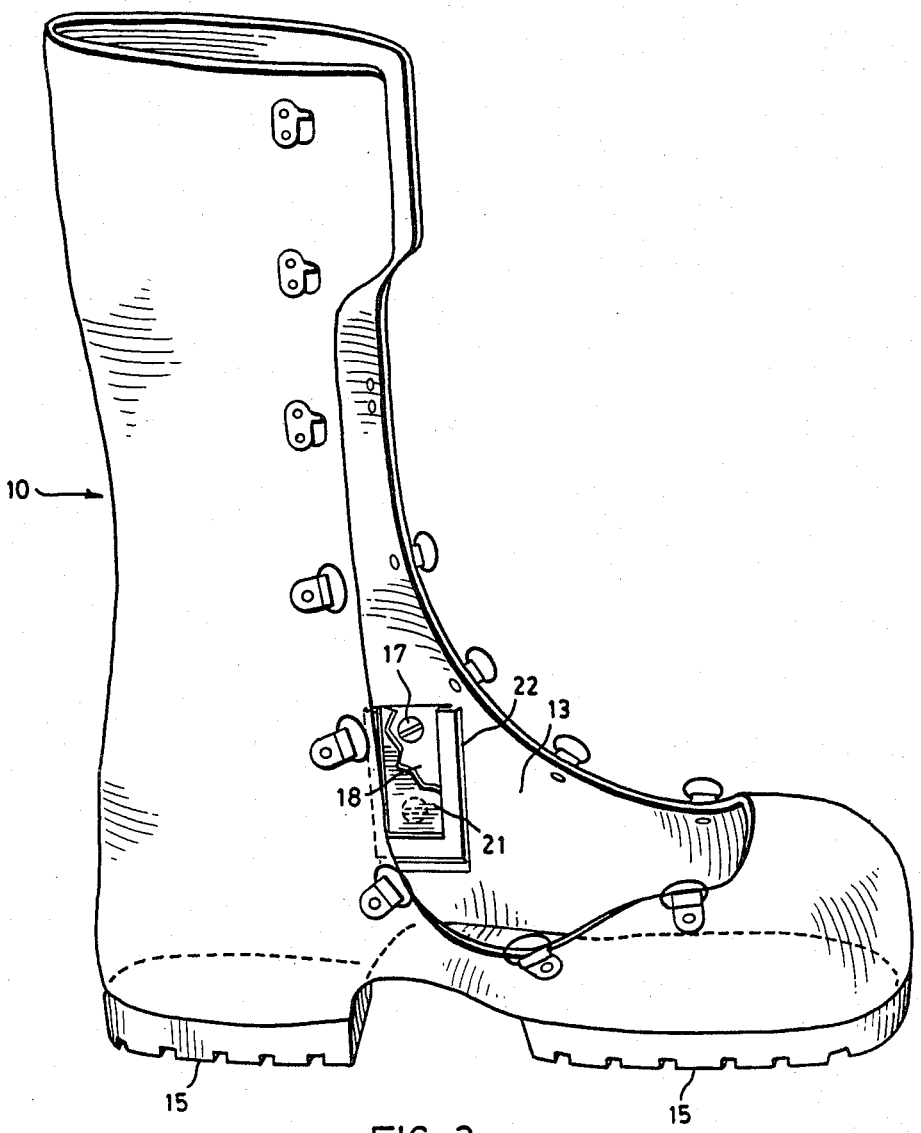
FIG. 3 is a perspective view of the climbing aid as seen from the side opposite to that of FIG. 1.

A reinforced steel plate 16 is embedded in the inside wall portion 13 of the shell, the plate being firmly implanted during the molding of the shell. The gaff 12 is rigidly but removably fastened to the plate 16 by setscrews 17 as best shown in FIGS. 2 and 3. The interior of the inside wall portion 13 is formed with a shallow oblong recess 18 and the plate 16 extends across the floor of the recess. The plate 16 has a pair of countersunk holes 19, 20 aligned with threaded holes in the gaff 12, and the gaff is fastened to the reinforcing plate 16 by the setscrews 17, the latter having countersunk heads which are recessed into the holes 19, 20 of the plate.

Thus the fastening is a sandwich structure with the inside wall portion 13 of the shell being rigidly clamped between the gaff 12 and the reinforcing plate 16. The heads of the setscrews 17, which are preferably Allen screws, are thus readily accessible from within the recess 18 to facilitate removal and replacement of the gaff.

The depth of the recess 18 is typically about $\frac{1}{8}$ inch, but in any case must be sufficient to provide an adequate air clearance between the plate 16 and the user's inner boot. As further protection for the user a panel 21 of electrically insulating plastics material covers the mouth of the recess. The panel 21 is simply a rectangular sliding panel which can be inserted into a retaining pocket formed by retaining flanges 22 extending around three sides of the recess. In order to gain access to the reinforcing plate for the purpose of replacing the gaff 12 it is only necessary to withdraw the sliding panel 21, which can be reinserted subsequently.

What I claim as my invention is:

1. A lineman's climbing aid comprising an outer boot adapted to be worn over a standard workboot and a replaceable steel gaff rigidly fastened exteriorly against an inside wall portion of the outer boot, wherein the outer boot comprises a one-piece molding of electrically insulating, water-impermeable, plastics material defining a rigid shell and a steel reinforcing plate embedded within said inside wall portion of the shell, the gaff being fastened to the reinforcing plate by fastening means extending through said inside wall portion whereby said inside wall portion is rigidly clamped between the reinforcing plate and the gaff.

2. A lineman's climbing aid according to claim 1, wherein said inside wall portion is formed with a shallow recess extending from the interior of the shell, the reinforcing plate extending across the floor of the recess and said fastening means being accessible from the recess for replacement of the gaff.

3. A lineman's climbing aid according to claim 2, wherein the fastening means are setscrews having countersunk heads recessed into the reinforcing plate.

4. A lineman's climbing aid according to claim 3, wherein the heads of the setscrews and the exposed area of the reinforcing plate are shielded by a removable covering of plastics material spaced therefrom and lying across the mouth of the recess.

5. A lineman's climbing aid according to claim 4, wherein the covering of plastics material comprises a sliding panel, the recess being formed with a peripheral pocket adapted to receive the sliding panel.

* * * * *